US010977985B2

(12) United States Patent
Yang et al.

(10) Patent No.: US 10,977,985 B2
(45) Date of Patent: Apr. 13, 2021

(54) DISPLAY DEVICE AND DRIVING METHOD THEREOF HAVING DEVICE DAMAGE COMPENSATION FUNCTION

(71) Applicant: Au Optronics Corporation, Hsinchu (TW)

(72) Inventors: Yi-Hsun Yang, Hsinchu (TW); Hsiang-Yuan Hsieh, Hsinchu (TW); Chin-Tang Chuang, Hsinchu (TW)

(73) Assignee: Au Optronics Corporation, Hsinchu (TW)

( * ) Notice: Subject to any disclaimer, the term of this patent is extended or adjusted under 35 U.S.C. 154(b) by 0 days.

(21) Appl. No.: 16/503,491

(22) Filed: Jul. 4, 2019

(65) Prior Publication Data

US 2020/0202769 A1 Jun. 25, 2020

(30) Foreign Application Priority Data

Dec. 25, 2018 (TW) ..... 107146887

(51) Int. Cl.
*G09G 3/32* (2016.01)

(52) U.S. Cl.
CPC ..... *G09G 3/32* (2013.01); *G09G 2320/0626* (2013.01); *G09G 2330/08* (2013.01)

(58) Field of Classification Search
CPC ..... G09G 3/32; G09G 2320/0626; G09G 2330/08
See application file for complete search history.

(56) References Cited

U.S. PATENT DOCUMENTS

| | | | | |
|---|---|---|---|---|
| 7,012,382 | B2 | 3/2006 | Cheang et al. | |
| 9,852,683 | B2 | 12/2017 | Liu | |
| 2014/0333219 | A1* | 11/2014 | Zijlstra | H05B 45/37 315/192 |
| 2015/0372052 | A1 | 12/2015 | Bower et al. | |
| 2017/0025075 | A1 | 1/2017 | Cok et al. | |
| 2018/0174519 | A1* | 6/2018 | Kim | H01L 33/42 |
| 2018/0211582 | A1* | 7/2018 | Sakariya | G09G 3/2088 |

FOREIGN PATENT DOCUMENTS

| | | |
|---|---|---|
| CN | 104167181 | 11/2014 |
| TW | I658448 | 5/2019 |

* cited by examiner

*Primary Examiner* — Wing H Chow
(74) *Attorney, Agent, or Firm* — JCIPRNET

(57) ABSTRACT

A display device and a driving method thereof are provided. The display device includes a first light-emitting diode, a first controller, a second light-emitting diode, and a second controller. The first controller has a first current source. The second controller has a second current source, wherein the first current source is coupled to a coupling point of the second light-emitting diode and the second current source. When the first light-emitting diode is normal, the first current source provides a first driving current to drive the first light-emitting diode. When the first light-emitting diode is open, the first current source stops providing the first driving current, and the second current source provides a second driving current to drive the second light-emitting diode.

20 Claims, 6 Drawing Sheets

DISPLAY DEVICE AND DRIVING METHOD THEREOF HAVING DEVICE DAMAGE COMPENSATION FUNCTION

CROSS-REFERENCE TO RELATED APPLICATION

This application claims the priority benefit of Taiwan application serial no. 107146887, filed on Dec. 25, 2018. The entirety of the above-mentioned patent application is hereby incorporated by reference herein and made a part of this specification.

BACKGROUND OF THE INVENTION

Field of the Invention

The invention relates to a display device and a driving method thereof, and more particularly, to a display device having a device damage compensation function for improving reliability and a driving method thereof.

Description of Related Art

In the system of a display device, regardless of the controller of an active matrix or a controlled device, such as a light-emitting diode (LED), it is difficult to totally avoid malfunction, which results in defects of the display device. Therefore, how to repair and compensate for these defects to improve the reliability of the display device and avoid a large increase in device cost is an important issue.

SUMMARY OF THE INVENTION

The invention provides a display device and a driving method thereof having device damage compensation function to improve the reliability of the display device.

The display device of the invention includes a first light-emitting diode, a first controller, a second light-emitting diode, and a second controller. The first controller has a first current source, wherein the first current source is coupled in series to the first light-emitting diode. The second controller has a second current source, and the second current source is coupled in series to the second light-emitting diode, wherein the first current source is coupled to a coupling point of the second current source and the second light-emitting diode. When the first light-emitting diode is normal, the first current source provides a first driving current to drive the first light-emitting diode. When the first light-emitting diode is open, the first current source stops providing the first driving current, and the second current source provides a second driving current to drive the second light-emitting diode.

The display device of the invention includes a controller, a plurality of first light-emitting diodes, and a plurality of second light-emitting diodes. The plurality of first light-emitting diodes are coupled to a first side of the controller and are respectively alternately arranged with the plurality of second light-emitting diodes, and the plurality of first light-emitting diodes are respectively coupled to the plurality of second light-emitting diodes, wherein each of the second light-emitting diodes receives a driving current, and when each of the second light-emitting diodes is open, the driving current corresponding to each of the second light-emitting diodes is transmitted to each of the corresponding first light-emitting diodes.

The driving method of the display device of the invention includes the following steps. A first current source is provided such that the first current source is coupled in series to a first light-emitting diode and the first current source is coupled to a first node. A second current source is provided such that the second current source is coupled in series to a second light-emitting diode and the second current source is coupled to the first node. When the first light-emitting diode is normal, the first current source provides a first driving current to drive the first light-emitting diode. When the first light-emitting diode is open, the first current source stops providing the first driving current, and the second current source provides a second driving current to drive the second light-emitting diode.

Based on the above, in the display device of the invention, the first light-emitting diode is driven by the first controller, and when the first light-emitting diode is open (for example, in a damaged state), the second light-emitting diode may be driven via the second controller to perform brightness compensation for defects caused by damage to the first light-emitting diode, thereby achieving the object of device damage compensation function and improving the reliability of the display device.

In order to make the aforementioned features and advantages of the disclosure more comprehensible, embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
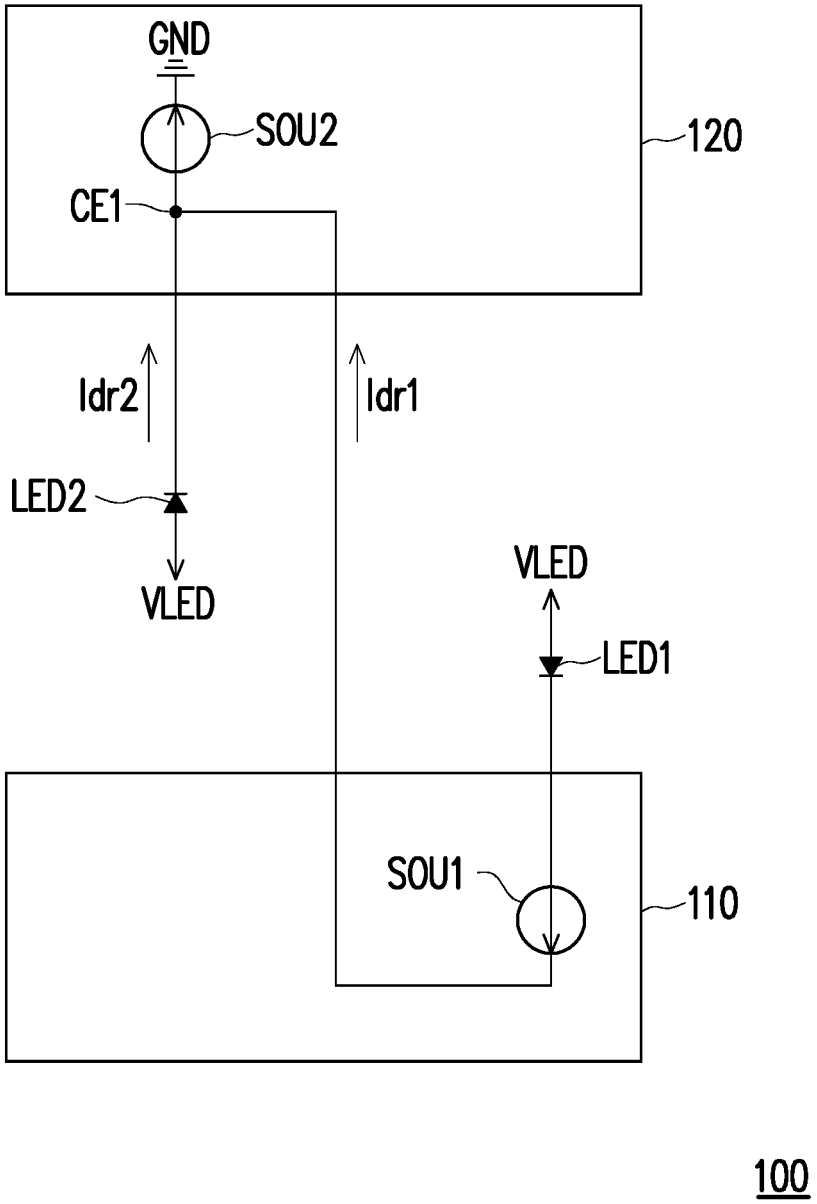
FIG. 1 shows a circuit block diagram of a display device of an embodiment of the invention.

In the figures, for clarity, the thicknesses of, for instance, layers, films, panels, and regions are enlarged. In the entire specification, the same reference numerals represent the same elements. It should be understood that, when a layer, film, region, or element of a substrate is "on" another element or "connected to" another element, the element may be directly on the other element or connected to the other element, or an intermediate element may be present. On the other hand, when an element is "directly on another element" or "directly connected to" another element, an intermediate element is not present. As used in the present specification, "connected to" may refer to a physical and/or electrical connection. Furthermore, "electrically connected" or "coupled" may mean that other elements are present between two elements.

Referring to FIG. 1, FIG. 1 shows a circuit block diagram of a display device of an embodiment of the invention. A display device 100 includes light-emitting diodes LED1 to LED2 and controllers 110 and 120. The controller 110 has a current source SOU1, and the current source SOU1 is coupled in series to the cathode of the light-emitting diode LED1, and the anode of the light-emitting diode LED1 receives a system voltage VLED. The controller 120 has a current source SOU2, one end of the current source SOU2 is coupled in series to the cathode of the light-emitting diode LED2, the other end of the current source SOU2 is coupled to a reference ground voltage GND, and the anode of the light-emitting diode LED2 also receives the system voltage VLED, wherein the light-emitting diode LED1 and the light-emitting diode LED2 have the same light-emitting wavelength, and the light-emitting diode LED1 and the light-emitting diode LED2 are alternately arranged with each other. In addition, the current source SOU1 is coupled to the coupling point of the current source SOU2 and the light-emitting diode LED2 (for example, a node CE1).

Accordingly, when the light-emitting diode LED1 is in a normal state (i.e., a state in which no damage occurs), the controller 120 causes the current source SOU2 to draw the current of the current source SOU1 so that the current source SOU1 provides a driving current Idr1 to turn on the light-emitting diode LED1. It should be noted that in the present embodiment, the current source SOU1 and the current source SOU2 have the same current size, so according to the Kirchhoffs Current Law (KCL), the current flowing into the node CE1 (i.e., the driving current Idr1 provided by the current source SOU1) is substantially the same as the current flowing out of the node CE1 (i.e., the current of the current source SOU2). Therefore, current does not flow through the light-emitting diode LED2 (i.e., the current value of a driving current Idr2 is, for example, zero or approaching zero), that is, when the light-emitting diode LED1 is in a normal state, the light-emitting diode LED2, which is a backup light-emitting diode, does not emit light.

Moreover, when the light-emitting diode LED1 is damaged and open, the current path of the driving current Idr1 is open, and the current source SOU1 stops providing the driving current Idr1. At this time, the current source SOU2 provides the driving current Idr2 to turn on the light-emitting diode LED2, so that the light-emitting diode LED2 may compensate for the brightness of the light that the light-emitting diode LED1 fails to provide. In this way, in the invention, when the light-emitting diode LED1 is in an open state, the light-emitting diode LED2 having the same light-emitting wavelength may be used as a backup light-emitting diode to compensate for defects of the display device 100 caused by damage to the light-emitting diode LED1, thus achieving the object of improving reliability.

Incidentally, in the display device 100 of the present embodiment, when the controller 110 is damaged, the controller 110 cannot provide the driving current Idr1. The controller 120 may cause the current source SOU2 to provide the driving current Idr2 to drive the light-emitting diode LED2 to compensate for the defect that the light-emitting diode LED1 cannot emit light due to the damage of the controller 110.

Figure 2A:
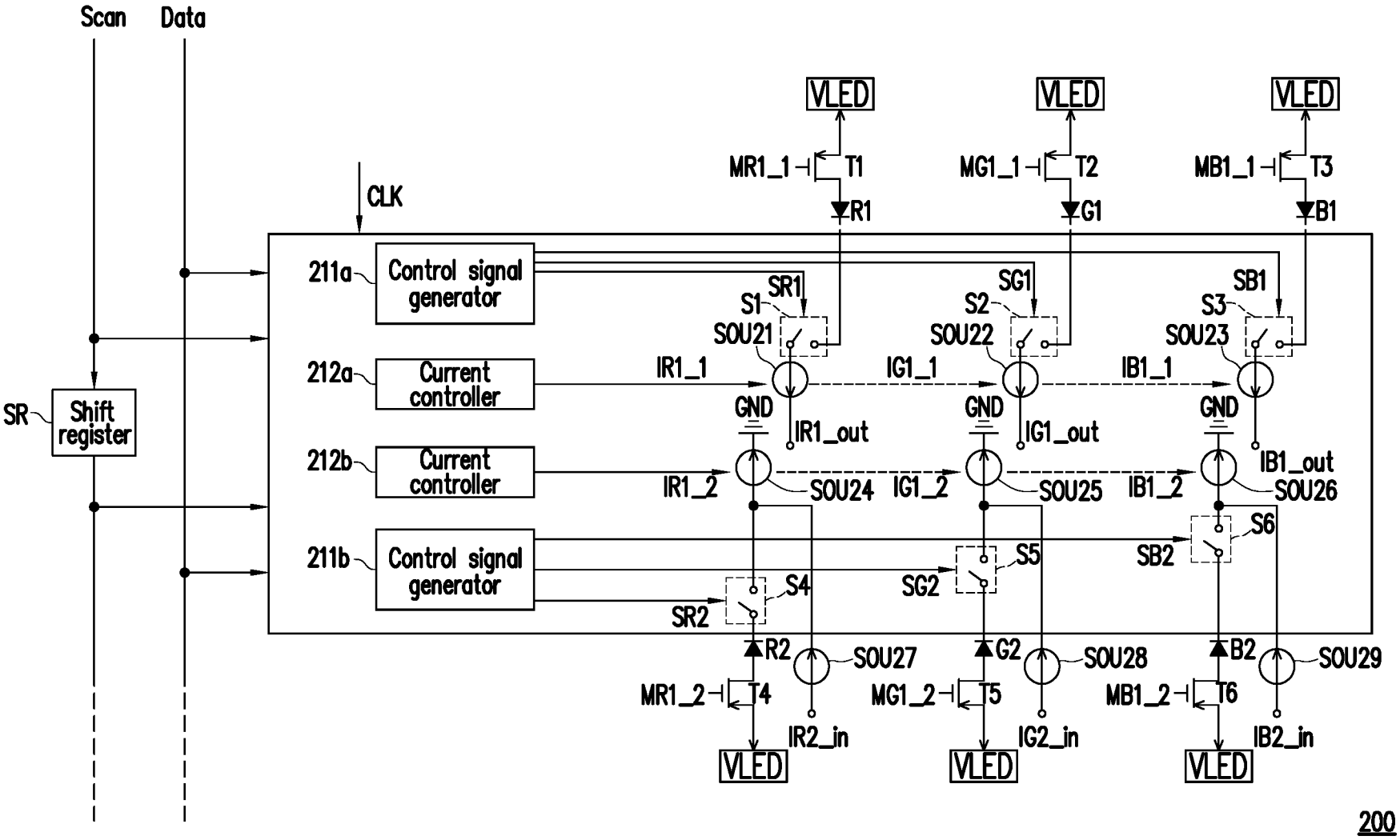
FIG. 2A shows a circuit block diagram of a display device of another embodiment of the invention.

Referring to FIG. 2A, FIG. 2A shows a schematic of a display device of another embodiment of the invention. A display device 200 of the present embodiment includes a shift register SR, light-emitting diodes R1 to R2, G1 to G2, B1 to B2, transistors T1 to T6, and a plurality of controllers (for example, a controller 210). It should be noted that the display device 200 of the invention includes a plurality of controllers coupled to each other (for example, an architecture of the coupling method of a plurality of groups of the controller 110 and the controller 120 shown in FIG. 1), and each controller in the display device 200 may respectively be coupled to a plurality of light-emitting diodes and a plurality of transistors. For simplicity of description, FIG. 2A only shows the controller 210 and the light-emitting diodes R1 to R2, G1 to G2, B1 to B2, and transistors T1 to T6 coupled to the controller 210 as an exemplary embodiment, but the invention does not actually limit the number of controllers, light-emitting diodes, and transistors, and those having ordinary skill in the art may adjust the number of controllers, light-emitting diodes, and transistors according to the actual application.

In addition, in the present embodiment, the light-emitting diodes R1, G1, and B1 serve as the main light-emitting diodes of the controller 210, and the light-emitting diodes R2, G2, and B2 serve as the lower-level backup light-emitting diodes to the main light-emitting diodes in the controller, but the invention is not limited thereto.

It should be noted that in the present embodiment, the light-emitting diodes R1 and R2 have the same light-emitting wavelength, and may be, for example, red light-emitting diodes. The light-emitting diodes G1 and G2 have the same light-emitting wavelength, and may be, for example, green light-emitting diodes. The light-emitting diodes B1 and B2 have the same light-emitting wavelength, and may be, for example, blue light-emitting diodes. In other words, the light-emitting wavelength of the light-emitting diodes R1 and R2 may be different from the light-emitting wavelength of the light-emitting diodes G1 and G2, and the light-emitting wavelength of the light-emitting diodes R1 and R2 may be different from the light-emitting wavelength of the light-emitting diodes B1 and B2. It should be noted that in other embodiments of the invention, the light-emitting diodes R1 and R2 may also have the same light-emitting wavelength as the light-emitting diodes G1, G2, B1, and B2, and the invention is not limited thereto. Those having ordinary skill in the art may adjust the light-emitting wavelengths of the light-emitting diodes R1 to R2, G1 to G2, and B1 to B2 according to actual application.

The controller 210 includes control signal generators 211*a* to 211*b*, current controllers 212*a* to 212*b*, switches S1 to S6, and current sources SOU21 to SOU29. The controller 210 receives a scan signal Scan, a data signal Data, and a clock signal CLK to determine whether to receive the data signal Data according to the scan signal Scan. Incidentally, the scan signal Scan, the data signal Data, and the clock signal CLK may be provided by, for example, a timing controller, but the invention is not limited thereto. Moreover, the shift register SR is configured to receive a pre-scan signal and provide a post-scan signal to enable each row of pixels of the display device 200 to scan sequentially. In detail, the shift register SR provides a plurality of sequentially enabled control signals MR1_1, MG1_1, and MB1_1 to turn on the transistors T1 to T3 so that the light-emitting diodes R1, G1, and B1 receive the system voltage VLED. In addition, a lower-level shift register of the shift register SR provides a plurality of sequentially enabled control signals MR1_2, MG1_2, and MB1_2 to turn on the transistors T4 to T6 to make the light-emitting diodes R2, G2, and B2 receive the system voltage VLED, and so on.

In addition, in the controller 210, the switch S1 is coupled between the light-emitting diode R1 and the current source SOU21, and is turned on or off according to a control signal SR1. The switch S2 is coupled between the light-emitting diode G1 and the current source SOU22, and is turned on or off according to a control signal SG1. A switch S3 is coupled between the light-emitting diode B1 and the current source SOU23, and is turned on or off according to a control signal SB1. The switch S4 is coupled between the light-emitting diode R2 and the current source SOU24, and is turned on or off according to a control signal SR2. The switch S5 is coupled between the light-emitting diode G2 and the current source SOU25, and is turned on or off according to a control signal SG2. The switch S6 is coupled between the light-emitting diode B2 and the current source SOU26, and is turned on or off according to a control signal SB2. It should be noted that the transistors T1 to T6 of the present embodiment may be implemented, for example, by using P-type transistors or N-type transistors, which is implemented herein as a P-type transistor as an exemplary embodiment, but the invention is not limited thereto. Further, the switches S1 to S6 of the present embodiment may also be implemented by, for example, P-type transistors or N-type transistors, and the invention is not limited in this regard.

Moreover, in the present embodiment, the control signal generator 211*a* is configured to supply the control signals SR1, SG1, and SB1 to control the switches S1 to S3, respectively. The control signal generator 211*b* is configured to provide the control signals SR2, SG2, and SB2 to control the switches S4 to S6, respectively. Incidentally, the control signals SR1 to SR2, SG1 to SG2, and SB1 to SB2 of the present embodiment may be, for example, pulse width modulation (PWM) signals, but the invention is not limited thereto. The current controller 212*a* is configured to provide current control signals IR1_1, IG1_1, and IB1_1 to respectively control the current sizes of the current sources SOU21 to SOU23 (for example, controlling the proportional values of the current values outputted by the current sources SOU21 to SOU23). The current controller 212*b* is configured to provide current control signals IR1_2, IG1_2, and IB1_2 to respectively control the current sizes of the current sources SOU24 to SOU26 (for example, controlling the proportional values of the current values outputted by the current sources SOU24 to SOU26). Incidentally, the current sources SOU27 to SOU29 are lower-level current sources in the controller of the controller 210. It should be noted that the device coupling method and the device damage compensation method between the controller 210 of the present embodiment and the lower-level controller are similar to the embodiment of FIG. 1 and are not repeated herein.

Figure 2B:
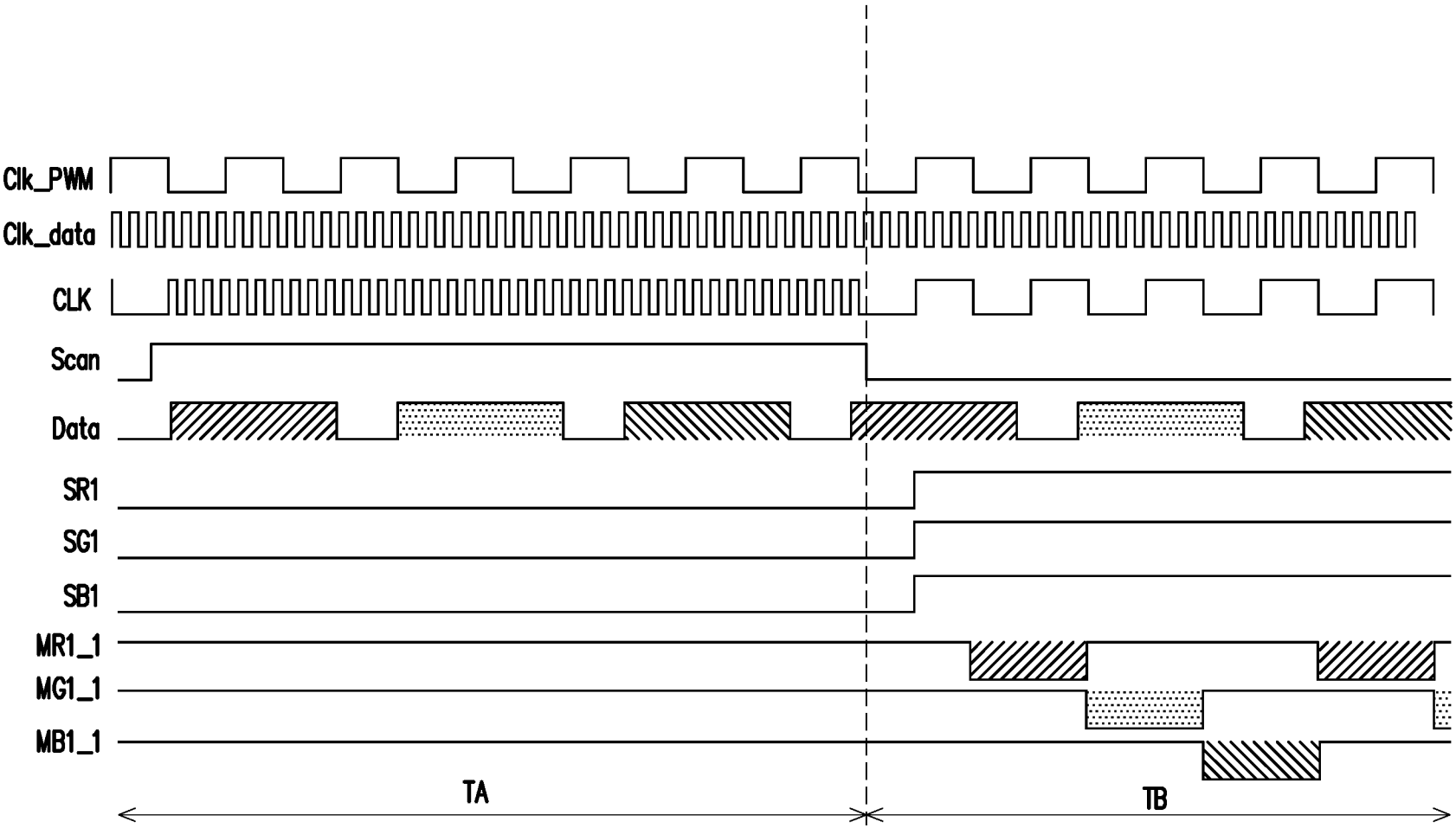
FIG. 2B shows a signal waveform diagram of a display device of the embodiment of FIG. 2A of the invention.

Next, please refer to FIG. 2A and FIG. 2B simultaneously. FIG. 2B shows a signal waveform schematic of the display device of the embodiment of FIG. 2A of the invention. In a time interval TA, the display device 200 performs a data access operation, and the scan signal Scan transitions from a disable voltage level to an enable voltage level. At this time, the controller 210 receives a switching frequency as the clock signal CLK of a pulse signal Clk_data and performs data access operation on the data signal Data according to the clock signal CLK. It should be noted that the switching frequency of the clock signal Clk_data is higher than the switching frequency of a clock signal Clk_PWM, and the clock signal Clk_data and the clock signal Clk_PWM may also be transmitted by, for example, a timing controller. In this way, the display device 200 of the present embodiment may perform data access operation via the clock signal Clk_data with a higher switching frequency, thereby accelerating data collection and access. Moreover, in the time interval TA, the control signals SR1, SG1, and SB1 and the control signals MR1_1, MG1_1, and MB1_1 are all disable voltage levels (i.e., at this point, the transistors T1 to T3 and the switches S1 to S3 are open). In addition, in the present embodiment, the voltage levels of the control signals SR2, SG2, and SB2 and the control signals MR1_2, MG1_2, and MB1_2 are the same as the control signals of the plurality of switches and the plurality of transistors of the main light-emitting diodes in the lower-level controller.

In a time interval TB after the time interval TA, the display device 200 performs a drive display operation, and the scan signal Scan transitions from the enable voltage level to the disable voltage level. At this time, the controller 210 receives the clock signal CLK for switching frequency to equal to a frequency of the clock signal Clk_PWM, provides the control signals SR1, SG1, and SB1 transitioned into the enable voltage level to turn on the switches S1 to S3, and provides the sequentially enabled control signals MR1_1, MG1_1, and MB1_1 to turn on the transistors T1 to T3, so that a plurality of current sources in the higher-level controller respectively draw current from the current sources SOU21, SOU22, and SOU23 to generate driving currents IR1_out, IG1_out, and IB1_out to drive the light-emitting diodes R1, G1, and B1, respectively.

Incidentally, when the main light-emitting diodes in the lower-level controller are damaged and open (or the lower-level controller is damaged), the current sources SOU27, SOU28, and SOU29 in the lower-level controller stop providing the driving current (for example, driving currents IR2_in, IG2_in, and IB2_in), and the controller 120 causes the current sources SOU24, SOU25, and SOU26 to respectively provide driving currents with the same current sizes as the current sources SOU27, SOU28, and SOU29 to drive the light-emitting diodes R2, G2, and B2. Incidentally, the light-emitting diodes R1, G1, and B1 in the display device 200 are alternately arranged with the backup light-emitting diodes in the higher-level controller, and the light-emitting diodes R2, G2, and B2 are alternately arranged with the main light-emitting diodes in the lower-level controller.

In addition, in other embodiments of the invention, it is mentioned that the functions of the transistors T1 to T6 may be replaced by the switches S1 to S6, that is, when the display device 200 of the present embodiment performs the drive display operation, the controller 210 provides the sequentially enabled control signals SR1, SG1, and SB1 to turn on the switches S1 to S3, so that the current sources SOU21, SOU22, and SOU23 may provide the driving currents IR1_out, IG1_out, and IB1_out to drive the light-emitting diodes R1, G1, and B1, respectively.

Figure 3:
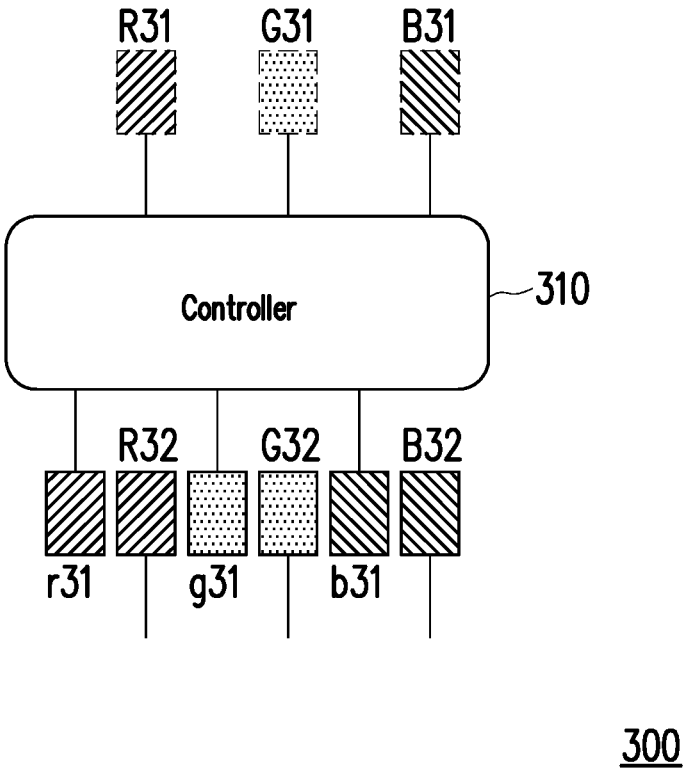
FIG. 3 shows a circuit block diagram of a display device of another embodiment of the invention.

Referring to FIG. 3, FIG. 3 shows a circuit block diagram of a display device of another embodiment of the invention. A display device 300 of the present embodiment includes a controller 310, a plurality of first light-emitting diodes (for example, light-emitting diodes r31, g31, and b31), and a plurality of second light-emitting diodes (for example, light-emitting diodes R32, G32, and B32). A plurality of first light-emitting diodes (i.e., the light-emitting diodes r31, g31, b31) are coupled to the first side of the controller 310 (e.g., the lower side of controller 310 in FIG. 3). The light-emitting diodes r31, g31, and b31 are alternately arranged with the light-emitting diodes R32, G32, and B32, respectively, and the light-emitting diodes r31, g31, and b31 are coupled to the light-emitting diodes R32, G32, and B32, respectively. It is worth mentioning that each of the light-emitting diode R32, G32, and B32 receives a driving current. When each of the light-emitting diodes R32, G32, and B32 is open, the driving current corresponding to each of the light-emitting diodes R32, G32, and B32 is transmitted to each of the corresponding light-emitting diodes r31, g31, and b31. It should be noted that in the present embodiment, the light-emitting diodes R32, G32, and B32 serve as the main light-emitting diodes of the lower-level controller of the controller 310, and the light-emitting diodes r31, g31, and b31 of the controller 310 serve as the backup light-emitting diodes of the main light-emitting diodes (i.e., the light-emitting diodes R32, G32, and B32) in the lower-level controller, but the invention is not limited thereto.

Further, in other embodiments of the invention, the display device 300 further includes a plurality of third light-emitting diodes (for example, light-emitting diodes R31, G31, and B31), and the light-emitting diodes R31, G31, and B31 are coupled to the second side of the controller 310 (e.g., the upper side of the controller 310 in FIG. 3), wherein the first side (i.e., the lower side) is opposite to the second side (i.e., the upper side), and the light-emitting diodes R31, G31, and B31 are alternately arranged with the light-emitting diodes r31, g31, and b31. In other words, the controller 310 of the present embodiment may also include main light-emitting diodes (i.e., the light-emitting diodes R31, G31, and B31), and the light-emitting diodes R31, G31, and B31 may be arranged with the light-emitting diodes r31, g31, and b31 in an asymmetric configuration.

It is not difficult to know from the above description that the display device 300 of the invention may control the main light-emitting diodes (i.e., the light-emitting diode R31, G31, and B31) and the backup light-emitting diodes (i.e., the light-emitting diodes r31, g31, and b31) simultaneously via one controller (for example, the controller 310). In this way, the invention may reduce the addition of controllers configured to only control the backup light-emitting diodes, which may increase the use efficiency of the controller and reduce device cost.

It should be noted that the driving method of the light-emitting diodes in the controller 310 of the present embodiment is similar to that of the embodiment of FIG. 2A, and details are not repeated herein. In addition, the device coupling method and the device damage compensation method between the controller 310 of the present embodiment and a lower-level controller are similar to those of the embodiment of FIG. 1, and details are not repeated herein.

Figure 4:
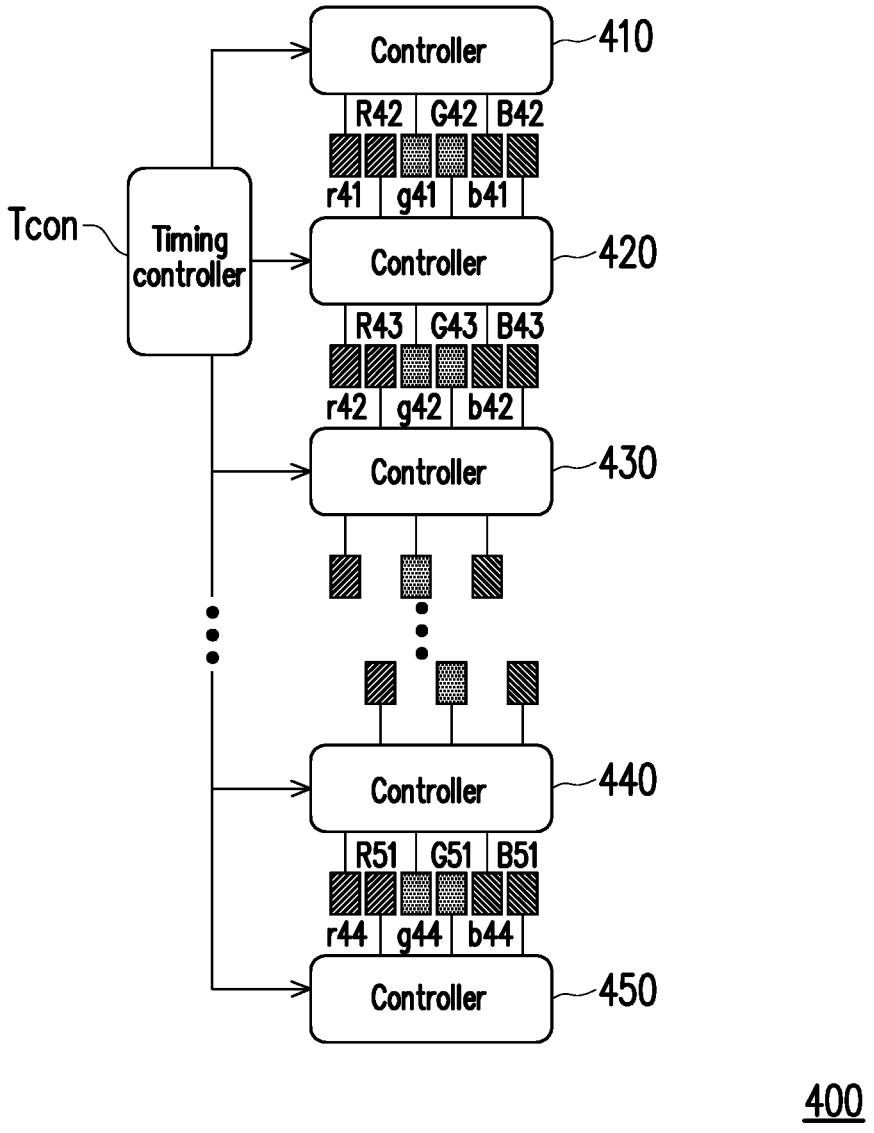
FIG. 4 shows a circuit block diagram of a display device of another embodiment of the invention.

Next, referring to FIG. 3 and FIG. 4 simultaneously, FIG. 4 shows a circuit block diagram of a display device of another embodiment of the invention. A display device 400 of the present embodiment includes a plurality of controllers (for example, controllers 410 to 450), a timing controller Tcon, and a plurality of light-emitting diodes corresponding to the controllers (i.e., light-emitting diodes R42 to R43, G42 to G43, B42 to B43, r41 to r42, g41 to g42, b41 to b42, R51, G51, B51, r44, g44, and b44). The timing controller Tcon is coupled to the controllers 410 to 450, and the timing controller Tcon is configured to provide a scan signal, a data signal, and a clock signal as described in the embodiment of FIG. 2A to the controllers 410 to 450, and details are not repeated herein. It should be noted that, to simplify the description, FIG. 4 of the invention only shows five controllers and corresponding light-emitting diodes, but the invention does not actually limit the number of controllers and light-emitting diodes corresponding to the controllers, and the depiction of FIG. 4 is not intended to limit the invention.

It is worth mentioning that in the present embodiment, the controllers 410 to 450 may be, for example, formed by a plurality of the controller 310 of FIG. 3, and the controller located at the uppermost side of the display device 400 of FIG. 4 (for example, the controller 410) includes only the backup light-emitting diodes (i.e., the light-emitting diodes r41, g41, and b41), and the controller located at the lowermost side of the display device 400 of FIG. 4 (for example, the controller 450) includes only the main light-emitting diodes (i.e. the light-emitting diodes R51, G51, and B51). It should be noted that the device coupling method and the device damage compensation method between the controllers 410 and 450 are similar to the embodiment of FIG. 1, and the detailed description thereof is also not repeated herein.

It is not difficult to know from the above description that in the display device 400 of the present embodiment, when at least one of the main light-emitting diodes of the controller is open, compensation may be made via the backup light-emitting diodes with the same light-emitting wavelength of an adjacent controller. For example, when the light-emitting diodes G42 and B42 of the main light-emitting diodes R42, G42, and B42 of the controller 420 are open, compensation may be made by driving the light-emitting diodes g41 and b41 with the same light-emitting wavelength in the adjacent controller 410. When the controller 430 is damaged, the light-emitting diodes R43, G43, and B43 may not be able to emit light due to the damage of the controller 430. In this case, compensation may be made by driving the light-emitting diodes r42, g42, and b42 with the same light-emitting wavelength in the adjacent controller 420, and so on.

Figure 5:
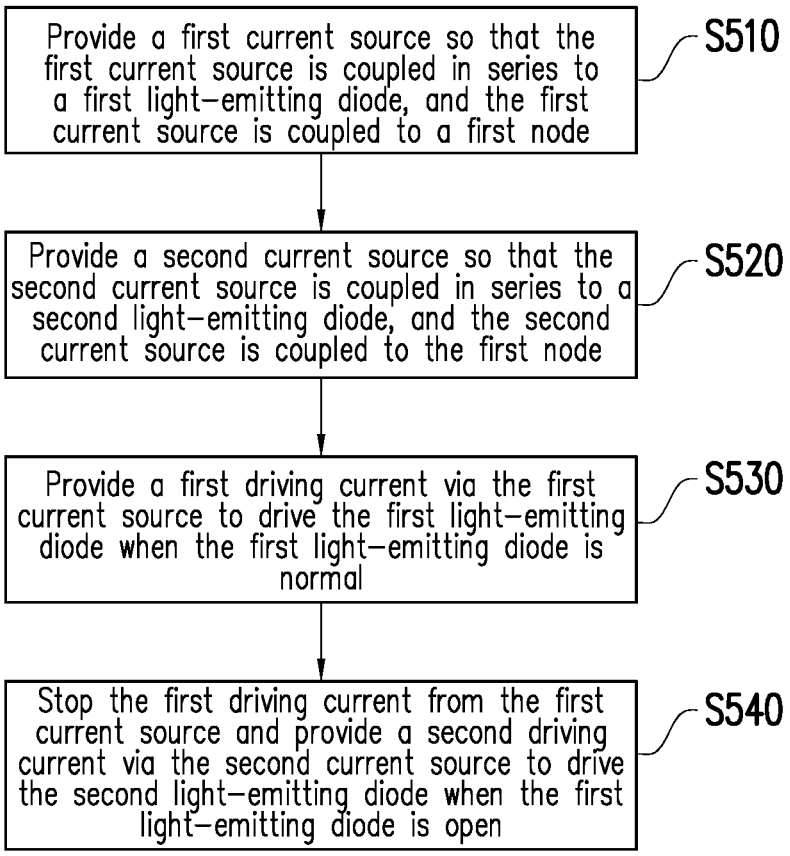
FIG. 5 shows a flowchart of a display device driving method of an embodiment of the invention.

Referring to FIG. 5, FIG. 5 shows a flowchart of a driving method of a display device of an embodiment of the invention. First, in step S510, a first current source is provided, the first current source is coupled in series to a first light-emitting diode, and the first current source is coupled to a first node. In step S520, a second current source is provided, the second current source is coupled in series to a second light-emitting diode, and the second current source is coupled to the first node. Next, in step S530, when the first light-emitting diode is normal, the first current source provides a first driving current to drive the first light-emitting diode. In step S540, when the first light-emitting diode is open, the first current source stops providing the first driving current, and the second current source provides a second driving current to drive the second light-emitting diode.

It should be noted that the implementation details of steps S510 to S540 are described in detail in the foregoing embodiments and implementations, and details are not repeated herein.

Based on the above, in the display device of the invention, the first light-emitting diode is driven by the first controller and the second light-emitting diode is driven by the second controller when the first light-emitting diode is damaged and open (or the first controller is damaged) to perform brightness compensation via the second light-emitting diode for defects caused by the damage of the first light-emitting diode, thereby achieving the object of device damage compensation function and effectively improving the reliability of the display device.

Although the invention has been described with reference to the above embodiments, it will be apparent to one of ordinary skill in the art that modifications to the described embodiments may be made without departing from the spirit of the invention. Accordingly, the scope of the invention is defined by the attached claims not by the above detailed descriptions.

What is claimed is:

1. A display device, comprising:

a first light-emitting diode;

a first controller having a first current source, wherein the first current source is coupled in series to the first light-emitting diode;

a second light-emitting diode; and a second controller having a second current source, wherein the second current source is coupled in series to the second light-emitting diode, wherein the first current source is coupled to a coupling point of the second current source and the second light-emitting diode, when the first light-emitting diode is normal, the first current source provides a first driving current to drive the first light-emitting diode and the second current source draws the first driving current from the first light-emitting diode simultaneously, and when the first light-emitting diode is open, the first current source stops providing the first driving current and the second current source provides a second driving current to drive the second light-emitting diode, wherein the first driving current has a same current size as the second driving current.

2. The display device of claim 1, wherein when the first controller is damaged, the second current source provides the second driving current to drive the second light-emitting diode.

3. The display device of claim 1, wherein the first controller further comprises:

a first switch coupled between the first light-emitting diode and the first current source;

a first control signal generator configured to provide a first control signal to control whether the first switch is turned on or off; and a first current controller configured to provide a first current control signal to control a current size of the first current source.

4. The display device of claim 3, wherein when the first light-emitting diode is normal, the first switch is turned on according to the first control signal, so that the first current source is drawn by the second current source to generate the first driving current.

5. The display device of claim 3, wherein the second controller further comprises:

a second switch coupled between the second light-emitting diode and the second current source;

a second control signal generator configured to provide a second control signal to control whether the second switch is turned on or off; and a second current controller configured to provide a second current control signal to control a current size of the second current source.

6. The display device of claim 5, wherein when the first light-emitting diode is open, the first current source stops providing the first driving current, the second switch is turned on according to the second control signal, and the second current source provides the second driving current to drive the second light-emitting diode.

7. The display device of claim 1, wherein the first light-emitting diode and the second light-emitting diode are alternately arranged with each other.

8. The display device of claim 1, wherein the display device further comprises:

at least one third light-emitting diode coupled in series to at least one third current source in the first controller; and at least one fourth light-emitting diode coupled in series to at least one fourth current source in the second controller, wherein the at least one third current source is coupled to a coupling point of the at least one fourth current source and the at least one fourth light-emitting diode, when the at least one third light-emitting diode is normal, the at least one third current source provides a third driving current to drive the at least one third light-emitting diode, when the at least one third light-emitting diode is open, the at least one third current source stops providing the third driving current, and the at least one fourth current source provides a fourth driving current to drive the at least one fourth light-emitting diode, wherein the third driving current has a same current size as the fourth driving current.

9. The display device of claim 8, wherein the first light-emitting diode, the second light-emitting diode, the at least one third light-emitting diode, and the at least one fourth light-emitting diode are alternately arranged with each other.

10. The display device of claim 8, wherein a light-emitting wavelength of the first light-emitting diode is the same as a light-emitting wavelength of the second light-emitting diode, the light-emitting wavelength of the first light-emitting diode is different from a light-emitting wavelength of the at least one third light-emitting diode, and the light-emitting wavelength of the first light-emitting diode is different from a light-emitting wavelength of the at least one fourth light-emitting diode.

11. A display device, comprising:

a controller; and a plurality of first light-emitting diodes coupled to a first side of the controller and respectively alternately arranged with a plurality of second light-emitting diodes, and the first light-emitting diodes are respectively coupled to the second light-emitting diodes through the controller, wherein when each of the second light-emitting diodes is normal, a driving current is provided to each of the second light-emitting diodes and the controller draws the driving current simultaneously, and when each of the second light-emitting diodes is open, the driving current corresponding to each of the second light-emitting diodes is transmitted to each of the corresponding first light-emitting diodes by the controller.

12. The display device of claim 11, wherein the first controller further comprises:

a first switch coupled to the first light-emitting diodes;

a first control signal generator configured to provide a first control signal to control whether the first switch is turned on or off; and a first current controller configured to provide a first current control signal to control a current size of the driving current.

13. The display device of claim 12, wherein when each of the second light-emitting diodes is open, the first switch is turned on according to the first control signal, and the driving current corresponding to each of the second light-emitting diodes is transmitted to each of the corresponding first light-emitting diodes.

14. The display device of claim 11, further comprising:

a plurality of third light-emitting diodes coupled to a second side of the controller, wherein the first side is opposite the second side.

15. The display device of claim 14, wherein the third light-emitting diodes are alternately arranged with the first light-emitting diodes.

16. The display device of claim 14, wherein the first controller further comprises:

a second switch coupled to the third light-emitting diodes; and a second control signal generator configured to provide a second control signal to control whether the second switch is turned on or off.

17. The display device of claim 16, wherein when the third light-emitting diodes are normal, the second switch is turned on according to the second control signal, so that the controller drives the third light-emitting diodes.

18. The display device of claim 11, wherein the first light-emitting diodes are alternately arranged with the second light-emitting diodes.

19. A driving method of a display device, comprising:

providing a first current source so that the first current source is coupled in series to a first light-emitting diode, and the first current source is coupled to a first node;

providing a second current source so that the second current source is coupled in series to a second light-emitting diode, and the second current source is coupled to the first node;

providing a first driving current via the first current source to drive the first light-emitting diode and drawing the driving current via the second current source simultaneously when the first light-emitting diode is normal; and stopping the first driving current from the first current source and providing a second driving current via the second current source to drive the second light-emitting diode when the first light-emitting diode is open, wherein the first driving current has a same current size as the second driving current.

20. The operation method of claim 19, wherein the operation method further comprises:

providing the second driving current via the second current source to drive the second light-emitting diode when the first current source is damaged.

* * * * *